United States Patent [19]

Seib

[11] 4,090,107

[45] * May 16, 1978

[54] ELECTRIC CIRCUIT CONTROL SYSTEM USING LOGIC DEVICE

[76] Inventor: James N. Seib, R.R. 1, Williams, Ind. 47470

[ * ] Notice: The portion of the term of this patent subsequent to Mar. 8, 1994, has been disclaimed.

[21] Appl. No.: 748,533

[22] Filed: Dec. 8, 1976

[51] Int. Cl.[2] ..... H05B 37/02; H05B 39/04

[52] U.S. Cl. ..... 315/156; 307/114; 315/361; 315/159; 315/208; 315/272; 307/252 B; 307/252 T; 307/293; 307/311

[58] Field of Search ..... 315/361, 159, 156, 208; 307/114, 115, 252 B

[56] References Cited

U.S. PATENT DOCUMENTS

| | | | |
|---|---|---|---|
| 2,510,713 | 6/1950 | Olsson | 315/360 X |
| 3,418,489 | 12/1968 | Platzer, Jr. | 307/252 B X |
| 3,932,770 | 1/1976 | Fantozzi | 307/252 UA |
| 4,011,482 | 3/1977 | Seib | 315/361 |

OTHER PUBLICATIONS

*Electronic Design,* vol. 20, Sept. 27, 1970, p. 69, A. J. Duelm, "Remote Control of a Triac Is Made Easy by Using One IC".

*Primary Examiner*—Alfred E. Smith
*Assistant Examiner*—Charles F. Roberts
*Attorney, Agent, or Firm*—Woodard, Weikart, Emhardt & Naughton

[57] ABSTRACT

A circuit is disclosed which is suitable for controlling lighting in a building from a multiple number of points. AC current to light bulbs is controlled by a triac which in turn is controlled by the output of an optical coupler which is controlled by the output of a logic device. The output of said logic device is connected to control the input to the triac. Switches connecting to the input of the logic device each can independently determine energization or deenergization of the light bulbs.

18 Claims, 2 Drawing Figures

ELECTRIC CIRCUIT CONTROL SYSTEM USING LOGIC DEVICE

BACKGROUND OF THE INVENTION

1. Field of the Invention

The invention relates to a switching system which is adaptable to include a plurality of switches for selectively controlling the application of electrical power to an electrical load.

2. Description of the Prior Art

Numerous clever circuits have been developed in the past for controlling the connection of an electrical supply source of its load. However, generally the wiring of homes and buildings uses conventional switches in line with the circuit from the AC power source to the electrical load. Where light fixtures in a home or business are to be switched on and off the wiring is of heavy gauge copper or aluminum and runs from the source of the AC power through one or more switches to the electrical load (which would be the light fixture). This results in an expensive wiring installation since the wiring to each switch and each switch itself must be sufficient to carry the total power needed by the electrical load. Such switches need relatively heavy duty contacts and incorporate high voltages which present some risk of shock in the event of failure or improper installation.

It has been known to replace this previously-described system with one incorporating relays which can latch either on or off. The individual switches used to control the relays can be operated from a large number of points at low AC voltages with relatively small gauge wire and relatively light duty switch contacts. Normally the control switches do not operate in the conventional toggle fashion to which persons are accustomed but rather have to be operated in one direction to turn the lights on and in another direction to turn the lights off in a momentary contact type of arrangement.

U.S. Pat. No. 3,418,489 to Platzer, Jr. discloses a third type of prior art switching circuit. This circuit incorporates a triac to control the current through a light bulb. The triac is controlled by two separate switches, each of which are single-pole single-throw switches. The switches control AC current which passes through separate windings on a transformer. When the state of either of the switches is changed the state of the conduction of the triac is changed. This provides independent control of the light from two separate locations. This technique, however, is not easily applied to situations which require control at more than two points. Further, transformers of the type disclosed tend to be either expensive or require a relatively large amount of current to achieve reliable control. It may further be noted that in the circuit of Platzer, Jr., U.S. Pat. No. 3,418,489, that high voltage from the source of AC power does appear at the switches.

SUMMARY OF THE INVENTION

The invention relates to electrical load control circuitry particularly suitable for controlling electric lights in homes and businesses and which includes a first switch for controlling DC signals to a logic device and means for readily connecting a second switch in a manner such that operation of the second switch would change the state of said logic device. The output of the logic device is a DC signal which connects to an AC control device for controlling power applied to the electrical load, possibly a light fixture.

The invention can be made appropriate for connecting any number of control switches by the parallel connection of said switches, with one switch terminal connected to ground and the other side of the switch connected to the input of the logic device to control the power to the load. These switches operate on low voltage DC and thereby may use very inexpensive switch contacts and very inexpensive connecting wire. Rigid building codes for high voltage AC wiring may be avoided.

With the two disclosed embodiments of the invention, interruption of power does not affect the state of the light after recovery. The invention can be produced extremely economically by the incorporation of integrated circuits into the lamp fixture or into the electrical outlet into which a lamp is to be plugged. Since the circuit can be connected to any number of switches with inexpensive wire, modifications of electrical systems after they are installed become extremely straightforward. Installation time can be substantially reduced since very low voltages and low currents involved in switching do not require the expensive wiring associated with conventional high voltage wiring to switches.

BRIEF DESCRIPTION OF THE DRAWINGS

FIG. 1 is a schematic diagram of one embodiment which includes a DC powered flip-flop and provides for control of a lamp from three separate switch locations.

FIG. 2 is a schematic diagram of a second embodiment which includes exclusive OR gates and provides for control of a lamp from five separate switch locations.

DESCRIPTION OF THE PREFERRED EMBODIMENTS

Figure 1:
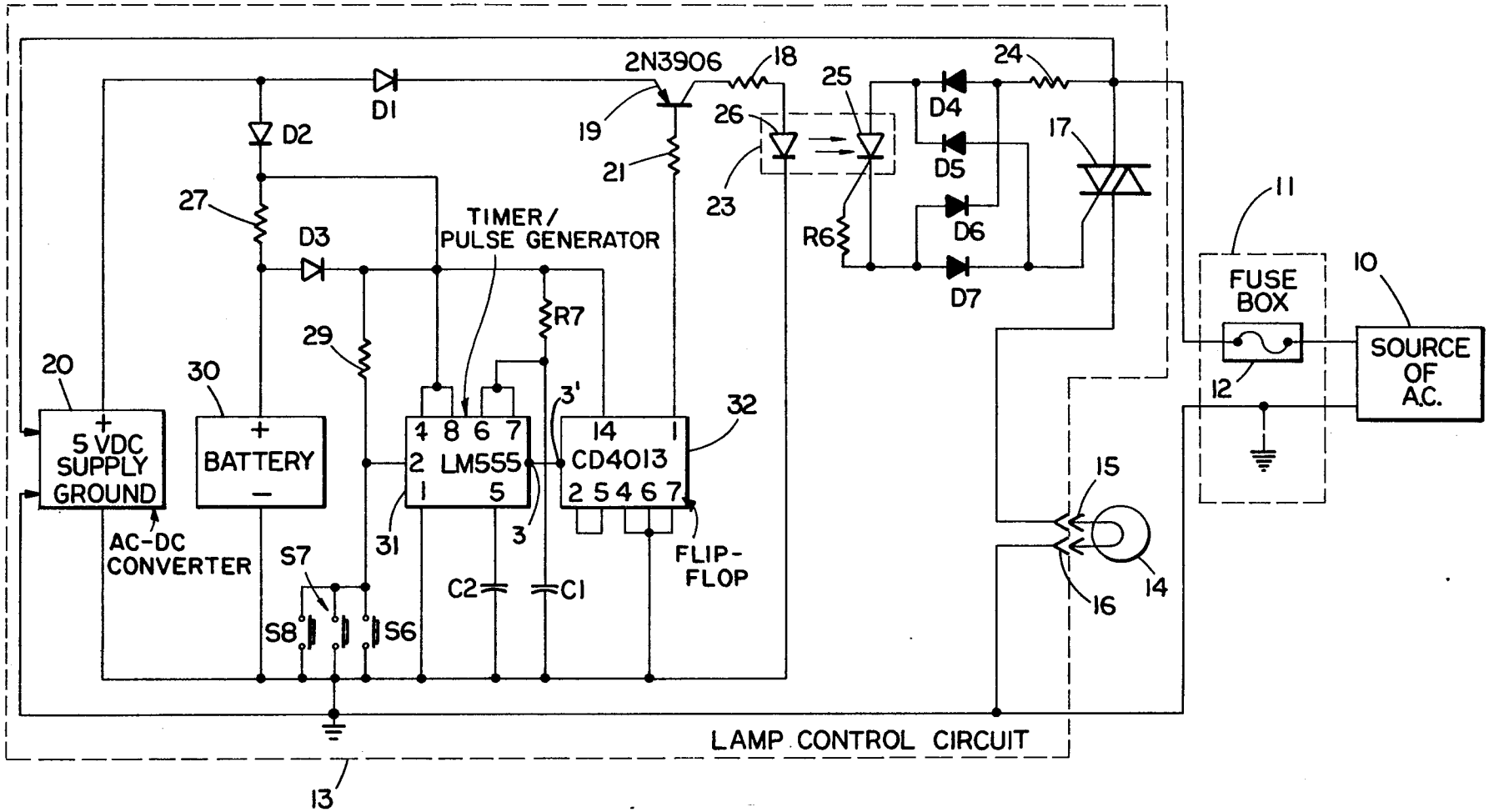
FIGS. 1 and 2 illustrate circuits incorporating the invention.

FIG. 1 is a circuit diagram of one embodiment of the present invention. There is illustrated an electrical load control circuit for remotely selectively energizing or deenergizing an electrical load. The circuit includes a source of AC 10 which provides a single phase, 120 volt AC supply source at 60 Hertz, with one side being grounded. The source of AC 10 provides power through a fuse box 11 which includes a fuse 12. The source of AC 10 connects through the grounded side to one side of lamp 14 which has a lamp base 15 inserted into socket 16 which serves as an electrical outlet. The lamp 14 serves as an electrical load consuming 25 watts of power when voltage is applied through a completed circuit. Lamp 14 is a conventional 25 watt incandescent light bulb, but higher-powered light bulbs could easily be used in the circuit of either embodiment.

The current through lamp 14 is controlled initially by a triac 17 connected to it. Triac 17 is preferably a General Electric SC251D. Triac 17 connects through fuse 12 to the ungrounded side of the source of AC 10. The triac in turn is controlled through resistor 24 and diodes D4–D7 by an optical coupling device 23. Device 23 is a General Electric H11C2 and includes an optically-controlled SCR 25 and a light emitting diode 26. Device 23 is controlled through resistor 18 by transistor 19, which is a 2N3906 transistor. Transistor 19 receives a +5 volts DC applied to its emitter through isolating diode D1 from DC power supply 20. DC power supply 20 connects to the source of AC 10 for its power and converts AC to +5 volts DC. Transistor 19, resistor 18, optical coupling device 23, diodes D4 through D7, resistors 24 and R6, and triac 17 provide a DC-operated AC control means for controlling the power applied to lamp 14 from the source of AC 10. This DC-operated AC control means is itself operated through resistor 21 by the output of DC-powered flip-flop 32. Flip-flop 32 is an RCA CD4013 with pin connections as shown. The DC-powered flip-flop 32 receives a signal at its input 3' from the output 3 of timer 31 resulting in one of two output states. Timer 31 is a National Semiconductor LM555 with pin connections as shown. Inherent in the design of a DC-powered flip-flop is the fact that there will be one output state when there is a timer pulse of sufficient duration and an alternate second output state when another similar pulse is delivered to said DC powered flip-flop. The term "toggle input" as used herein refers to the input of a flip-flop which operates in this fashion (changes state with each successive input pulse).

The trigger input (pin 2) of the timer 31 is connected to switch S6 which is a manually-operable switch connected to control the time. Pull up resistor 29 assists in proper functioning of the timer. Switches S7 and S8 are connected in parallel with switch S6. Momentary operation of any one of these switches S6 through S8 will cause a change of state in the DC-powered flip-flop, which will in turn cause the triac to change its mode of conduction thereby changing the state of operation of the light load. Timer 31 with its associated resistor R7 and capacitors C1 and C2 is used in the circuit to prevent undesired switching on or off due to contact bounce of any one of the switches S6 through S8. Timer 31 functions as a one-shot multivibrator.

It can be noted that one side of each of the switches S6 through S8 connects to ground and the other side connects to the trigger input of timer 31. With this arrangement, only one wire needs to be connected from a switch to the timer trigger input, a common ground being used to provide the other switch connections. This results in a minimum amount of wire being needed.

A battery 30 is provided as a means to prevent a change in state of the DC-powered flip-flop when there is a loss of AC from the 120 volt AC supply 10. When supply 20 is functioning, power is supplied to the timer 31 and flip-flop 32 through isolating diode D2. Diode D3 prevents this supply voltage from appearing directly on the battery 30 thus leaving resistor 27 as the path for a trickle charging current. When the +5 VDC supply is not functioning diode D2 isolates the voltage of battery 30 from transistor 19 and DC supply 20, thus preventing a large current drain through the transistor 19 and the light emitting diode of the optical coupling device 23.

Figure 2:
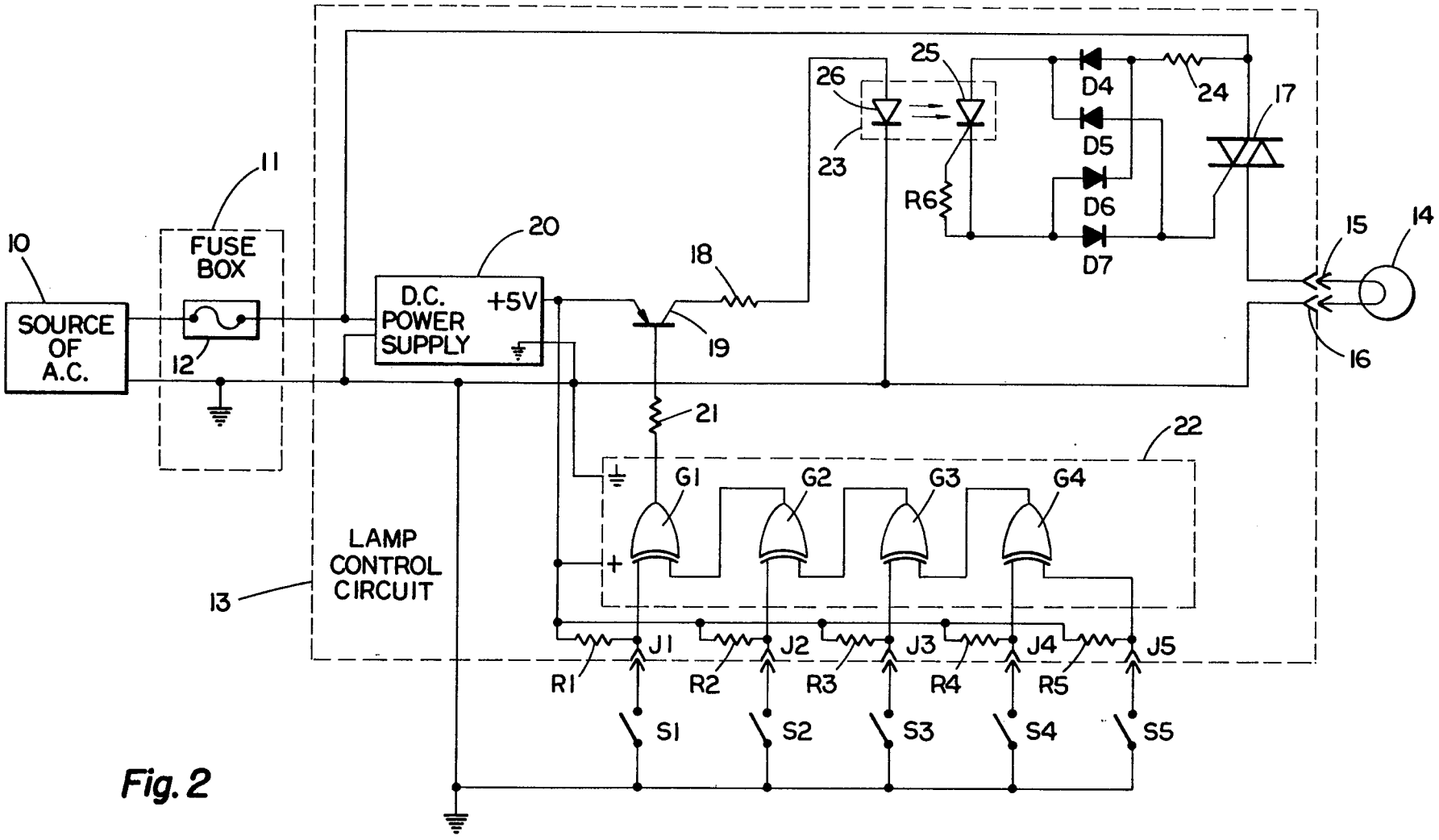

FIG. 2 is a circuit diagram of another preferred embodiment. U.S. Pat. No. 4,011,482 to Seib entitled Electric Current Control System Using Exclusive "OR" Gate, is hereby incorporated by reference, and the embodiment of FIG. 2 shows those improvement features which are additionally claimed. The circuit arrangement of switches S1 through S5 and I.C. 22 functions as described in said patent. The changes include the addition of an optical coupling device 23, diodes D4 through D7, and resistors 24 and R6. Changes further include the placement of the lamp 14 between the triac and ground. The current of lamp 14 is controlled initially by a triac 17 which is preferably a General Electric SC251D. Triac 17 in turn is controlled through resistor 24, diodes D4 through D7 by an optical coupling device 23 which is a General Electric H11C2 biased by resistor R6. Device 23 is controlled through resistor 18 by transistor 19.

The network arrangement of diodes D4 through D7 is the same in both FIGS. 1 and 2 and provides a means whereby the positive and negative portions of the AC supply source signal pass by different paths to the SCR portion 25 of optical coupling device 23. This arrangement allows the use of a device designed for DC control to be used in controlling AC to the gate of triac 17. Triac 17 in turns controls the application of AC from the 120 VAC supply source 10 to the electrical load 14.

When device 23 is "on" and conducting, the positive portion of the AC causes current to be delivered to the gate of triac 17 through resistor 24, diode D4, device 23 and diode D7. The negative portion causes current to be delivered to the gate of triac 17 through resistor 24, diode D6, device 23 and diode D5. Thus, triac 17 is "on" when device 23 is "on". When device 23 is "off" is precludes connection of the AC to the gate of triac 17 thus causing it to be "off."

If desired, the above circuit can be modified to add additional features. A time delay network can be added between resistor 21 and transistor 19, if desired, to provide a lengthy delay in the extinguishing of lamp 14 as is sometimes desirable. In addition, the circuit could be modified to incorporate light dimming circuitry. While the above circuitry is most appropriate for use with electric lamps, it is apparent that it could equally be used with any electrical outlet to control any device plugged in that outlet. It is envisioned that the lamp control unit 13 will be built in one integrated piece to incorporate an outlet (such as a plug receptacle or a lamp socket) together with the associated AC control device and logic device.

While there has been described above the principles of this invention in connection with the specific circuit, it is to be clearly understood that this description is made only by way of example and not as a limitation to the scope of the invention.

What is claimed is:

1. An electrical load control circuit for remotely selectively energizing or de-energizing an electrical load which comprises:

(a) an AC supply source;

(b) an electrical load;

(c) a DC operated AC control means for controlling the power applied to said electrical load from said AC supply source;

(d) said AC control means capable of providing at least 25 watts of power;

(e) a DC powered flip-flop circuit means having a toggle input and producing a first DC signal in its one output state and a second DC signal in its other output state;

(f) the output of said flip-flop circuit means being connected to operate said AC control means;

(g) a first manually operable switch electrically connected to control the toggle input of said flip-flop circuit means so that operation of said switch will change the state of energization of said electrical load;

(h) a DC power supply for converting the AC from the said AC supply source to DC, said DC power supply connecting to and providing power to said DC powered flip-flop when said AC supply source is functioning; and (i) a battery connected to said DC powered flip-flop for providing power to said DC powered flip-flop when said AC supply source is not functioning.

2. The circuit of claim 1 which additionally includes a second manually-operable switch electrically connected to control the toggle input of said flip-flop.

3. The circuit of claim 2 which additionally includes a timer electrically connected between said manually-operable switches and the toggle input of said flip-flop.

4. The load control circuit of claim 1 in which said load includes an incandescent light.

5. The load control circuit of claim 4 in which said light is at least a 25 watt light and said AC supply source is about 120 volts at 60 Hertz.

6. The load control circuit of claim 1 in which said AC supply source is about 120 volts at 60 Hertz and said load consumes at least 25 watts when power is applied to it.

7. The electrical load control circuit of claim 6 which additionally includes means for providing power to said battery from said DC power supply whereby the state of charge of said battery can be maintained.

8. The electrical load control circuit of claim 7 which additionally includes a second manually-operable switch electrically connected to control the toggle input of said flip-flop.

9. The circuit of claim 8 which additionally includes a timer electrically connected between said manually-operable switches and the toggle input of said flip-flop.

10. The load control circuit of claim 8 in which said DC operated AC control means includes a triac.

11. The load control circuit of claim 10 which additionally includes a third manually-operable switch connected in parallel with said first and second manually-operable switches.

12. The load control circuit of claim 11 in which one side of said AC supply source is ground and one side of said first, second and third manually-operable switches are electrically connected together and to ground.

13. An electrical load control circuit for remotely selectively energizing or de-energizing an electrical load which comprises:

(a) an AC supply source of at least about 120 volts at about 60 Hertz;

(b) an electrical load;

(c) a DC operated AC control means for controlling the power applied to said electrical load from said AC supply source, said AC control means being capable of controlling at least 25 watts of power;

(d) said AC control means including an optical coupling means for providing electrical isolation between the input and the output of said AC control means;

(e) a DC power supply for converting the AC from the AC supply source to DC, said DC power supply providing power to DC operated AC control means; and (f) a first manually operable switch electrically connected to control the optical coupler.

14. The circuit of claim 13 which additionally includes a second manually operable switch electrically connected to control the optical coupler.

15. The load control circuit of claim 13 which additionally includes a DC powered logic device operable to produce alternate ones of two output states and electrically connected to operate said AC control means.

16. The circuit of claim 15 which additionally includes a timer electrically connected between said manually operable switches and said DC powered logic device.

17. In a building having an electrical outlet controlled from two separate locations with a manually operable switch located at each of the two locations, the building being supplied with an AC supply source of about 120 volts at 60 Hertz and having the ability to supply at least 25 watts of power to the electrical outlet, the improvement comprising a control circuit which includes:

(a) a DC operated AC control means for controlling the power applied to said outlet from said AC supply source;

(b) a DC powered flip-flop circuit means having a toggle input for producing a first DC signal in its one output state and a second DC signal in its other output state;

(c) the output of said flip-flop circuit means being connected to oerate said AC control means;

(d) one of the manually operable switches electrically connected to control the toggle input of said flip-flop circuit means so that operation of said switch will change the state of the output of said flip-flop circuit means; and (e) the other of the manually operable switches electrically connected to control the toggle input of said flip-flop circuit means so that operation of said other switch will change the state of the output of said flip-flop circuit means.

18. In the building of claim 17, said AC supply source being single phase with one side grounded, the grounded side connecting directly to said electrical outlet and the other side connecting to said electrical outlet through said AC control means.

* * * * *